US006700319B2

(12) United States Patent
Michalchuk et al.

(10) Patent No.: US 6,700,319 B2
(45) Date of Patent: Mar. 2, 2004

(54) CATHODE-RAY TUBE HAVING A TENSION MASK WITH MICROPHONICS CONTROL

(75) Inventors: Joey John Michalchuk, Lambertville, NJ (US); Richard William Nosker, Princeton, NJ (US)

(73) Assignee: Thomson Licensing S. A., Boulogne Cedex (FR)

( * ) Notice: Subject to any disclaimer, the term of this patent is extended or adjusted under 35 U.S.C. 154(b) by 159 days.

(21) Appl. No.: 09/997,685

(22) Filed: Nov. 29, 2001

(65) Prior Publication Data

US 2003/0098641 A1 May 29, 2003

(51) Int. Cl.[7] ..... H01J 29/80

(52) U.S. Cl. ..... 313/402; 313/406; 313/407; 313/408; 313/269

(58) Field of Search ..... 313/402–406, 313/407, 408, 269

(56) References Cited

U.S. PATENT DOCUMENTS 5,406,168 A * 4/1995 Takagi ..... 313/402
5,646,478 A 7/1997 Nosker et al. ..... 313/402
6,157,121 A * 12/2000 Ragland et al. ..... 313/403
6,188,169 B1 * 2/2001 Takayanagi ..... 313/407
6,566,797 B2 * 5/2003 Reed ..... 313/407

OTHER PUBLICATIONS

Japanese Kokai patent application No. P2000–77007A; Hideo Suzuki et al.; Publication Date: Mar. 14, 2000; Filing No. Hei 10 [1998] 246913.

* cited by examiner

*Primary Examiner*—Nimeshkumar D. Patel
*Assistant Examiner*—Sikha Roy
(74) *Attorney, Agent, or Firm*—Joseph S. Tripoli; Joseph J. Laks; Carlos M. Herrera

(57) ABSTRACT

A cathode-ray tube having a luminescent screen on a face-plate panel and a tension mask assembly, wherein the assembly comprises a pair of support blades for supporting a tension mask. The tension mask has a pair of mask borders each being fixed to a respective support blade and a plurality of strands extending between the mask borders. The mask further comprises cross wires extending generally perpendicular to the strands on a screen facing side and at least one shield assembly extending between and attached to the mask borders. The shield assembly has a sheath extending along one side of the mask in contact with at least one strand and a shield attached to the cross wires of the mask in overlapping relation to the sheath.

6 Claims, 2 Drawing Sheets

CATHODE-RAY TUBE HAVING A TENSION MASK WITH MICROPHONICS CONTROL

FIELD OF THE INVENTION

This invention relates generally to cathode-ray tubes having tension mask assemblies and, more particularly, to tension mask assemblies having vibration damping means.

BACKGROUND OF THE INVENTION

A color cathode ray tube, or CRT, includes an electron gun for forming and directing three electron beams to a screen of the tube. The screen is located on the inner surface of the faceplate panel of the tube and is made up of an array of elements of three different color-emitting phosphors. A shadow mask, which may be either a formed mask or a tension mask having strands, is located between the electron gun and the screen. The electron beams emitted from the electron gun pass through apertures in the shadow mask and strike the screen causing the phosphors to emit light so that an image is displayed on the viewing surface of the faceplate panel.

One type of CRT has a tension mask comprising a set of strands that are tensioned onto a mask support frame to reduce their propensity to vibrate at large amplitudes under external excitation. Such vibrations would cause gross electron beam misregister on the screen and would result in objectionable image anomalies to the viewer of the CRT.

Vibrations causing gross electron beam misregister may be created by microphonic sources within the TV set. Although it is difficult to control the amount of vibration generated by these microphonic sources, it is necessary to have the tension mask within the CRT be adaptable to this environment in which such microphonic vibrations exist. While tensioning the mask strands reduces electron beam misregister, further reductions are necessary. It is therefore desirable to develop a mask frame assembly having vibration damping characteristics for further minimizing the undesirable result of electron beam misregister on the screen caused by vibration sources within the TV set.

SUMMARY OF THE INVENTION

A cathode-ray tube having a luminescent screen on a faceplate panel and a tension mask assembly, wherein the assembly comprises a pair of support blades for supporting a tension mask. The tension mask has a pair of mask borders each being fixed to a respective support blade and a plurality of strands extending between the mask borders. The mask further comprises cross wires extending generally perpendicular to the strands on a screen facing side and at least one shield assembly extending between and attached to the mask borders. The shield assembly has a sheath extending along one side of the mask in contact with at least one strand and a shield attached to the cross wires of the mask in overlapping relation to the sheath.

BRIEF DESCRIPTION OF THE DRAWINGS

The invention will now be described by way of example with reference to the accompanying figures of which.

DETAILED DESCRIPTION OF THE INVENTION

Figure 1:
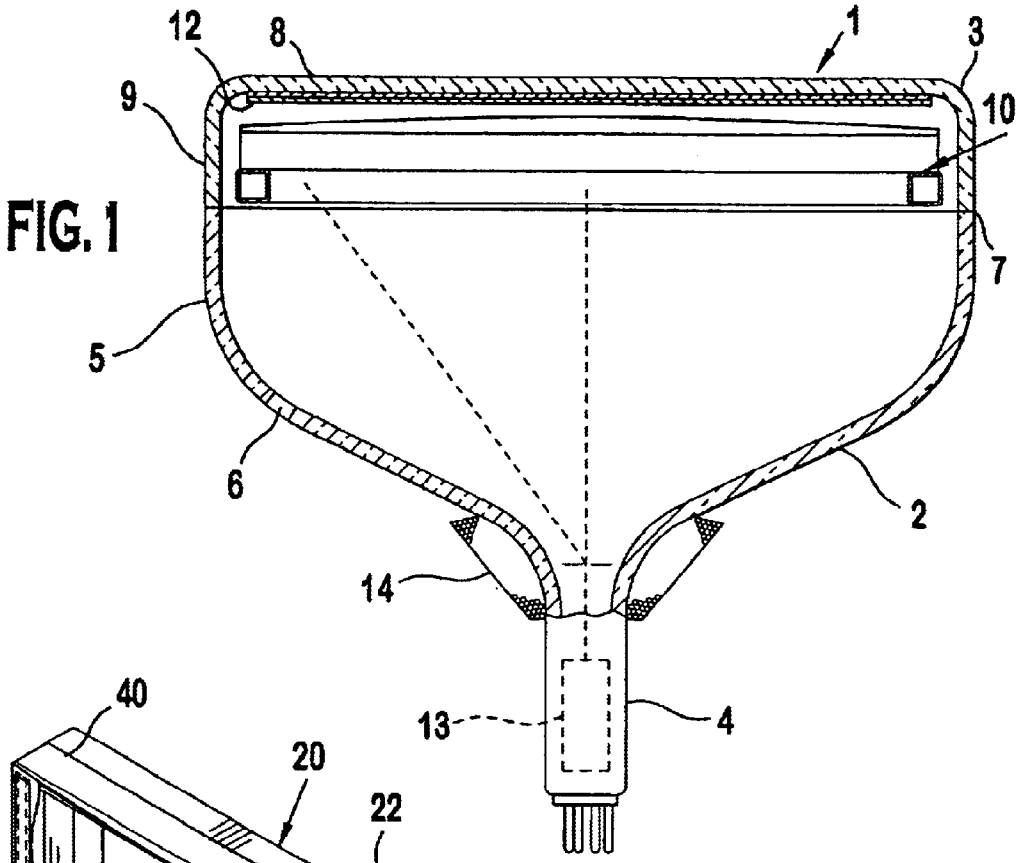
FIG. 1 is a cross sectional view of a CRT showing a tension mask frame assembly.

FIG. 1 shows a cathode ray tube (CRT) 1 having a glass envelope 2 comprising a rectangular faceplate panel 3 and a tubular neck 4 connected by a funnel 5. The funnel 5 has an internal conductive coating (not shown) that extends from an anode button 6 toward the faceplate panel 3 and to the neck 4. The faceplate panel 3 comprises a viewing faceplate 8 and a peripheral flange or sidewall 9, which is sealed to the funnel 5 by a glass frit 7. A three-color phosphor screen 12 is carried by the inner surface of the faceplate panel 3. The screen 12 is a line screen with the phosphor lines arranged in triads, each of the triads including a phosphor line of each of the three colors. A tension mask support frame assembly 10 is removably mounted in predetermined spaced relation to the screen 12. An electron gun 13, shown schematically by dashed lines in FIG. 1, is centrally mounted within the neck 4 to generate and direct three inline electron beams, a center beam and two side or outer beams, along convergent paths through the tension mask frame assembly 10 to the screen 12.

The CRT 1 is designed to be used with an external magnetic deflection yoke 14 shown in the neighborhood of the funnel-to-neck junction. When activated, the yoke 14 subjects the three beams to magnetic fields which cause the beams to scan horizontally and vertically in a rectangular raster over the screen 12.

Figure 2:
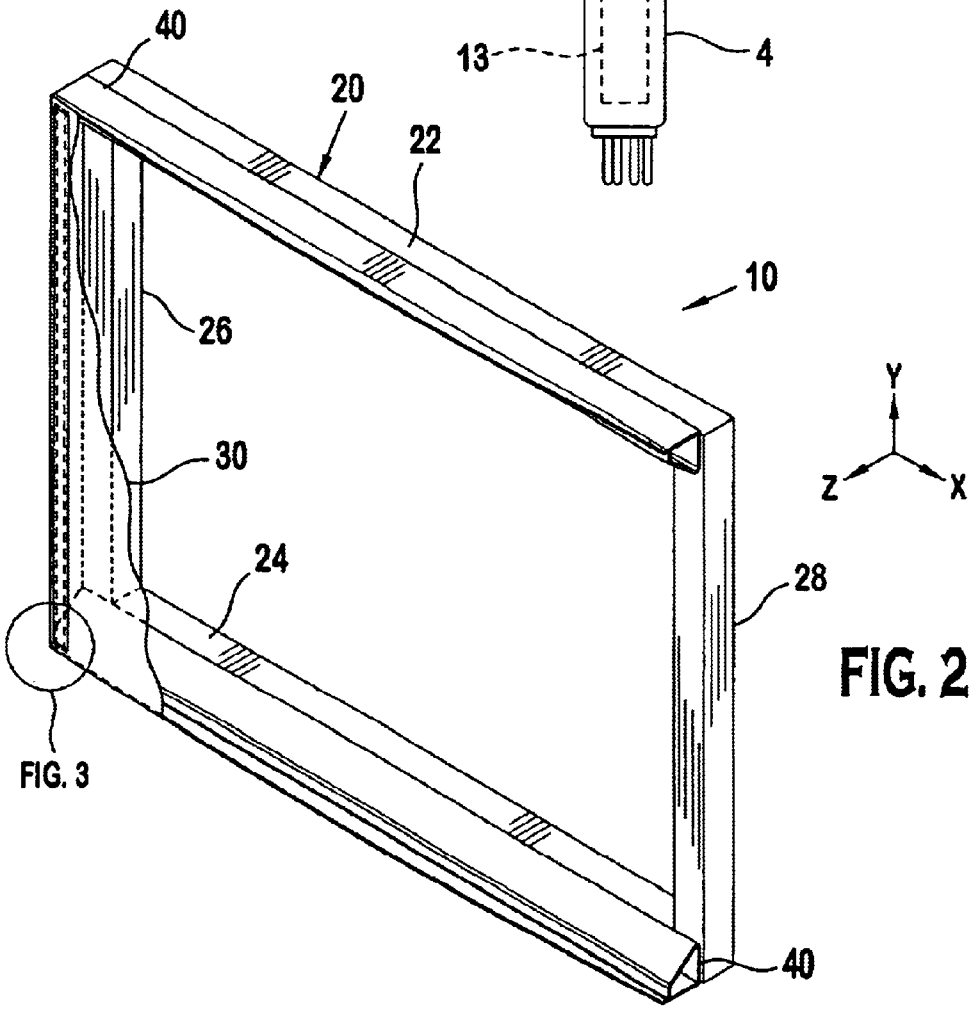
FIG. 2 is a perspective view of the tension mask frame assembly.

The tension mask support frame assembly 10, as shown in FIG. 2, includes two long sides 22, 24, and two short sides 26, 28. The two long sides 22, 24 of the tension mask support frame assembly 10 are parallel to a central major axis, X, of the tube; and the two short sides 26, 28 are parallel to a central minor axis, Y, of the tube. The sides 22, 24, 26, 28 are preferably formed of rectangular tubular material. The two long sides 22, 24 and two short sides 26, 28 preferably form a continuous mask support frame 20 in which the long sides 22, 24 lie in a common plane generally parallel to a tension mask 30. A tension mask support blade member 40 is mounted to each of the long sides 22, 24 for supporting the tension mask 30. The tension mask 30 is attached to each support blade member 40 as will described below in further detail.

Figure 3:
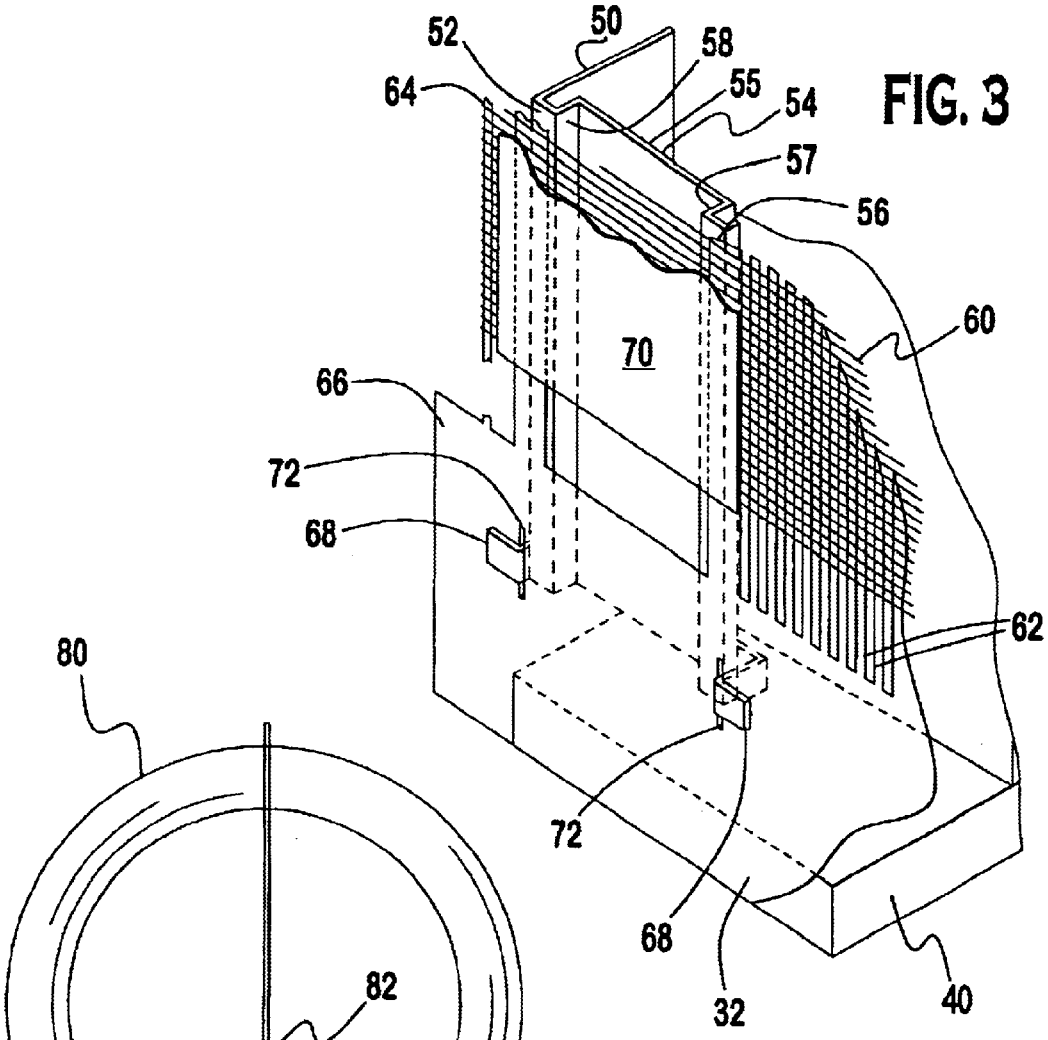
FIG. 3 is a partial perspective view of the corner section shown in FIG. 2 having a damping mechanism according to the invention.
Figure 4:
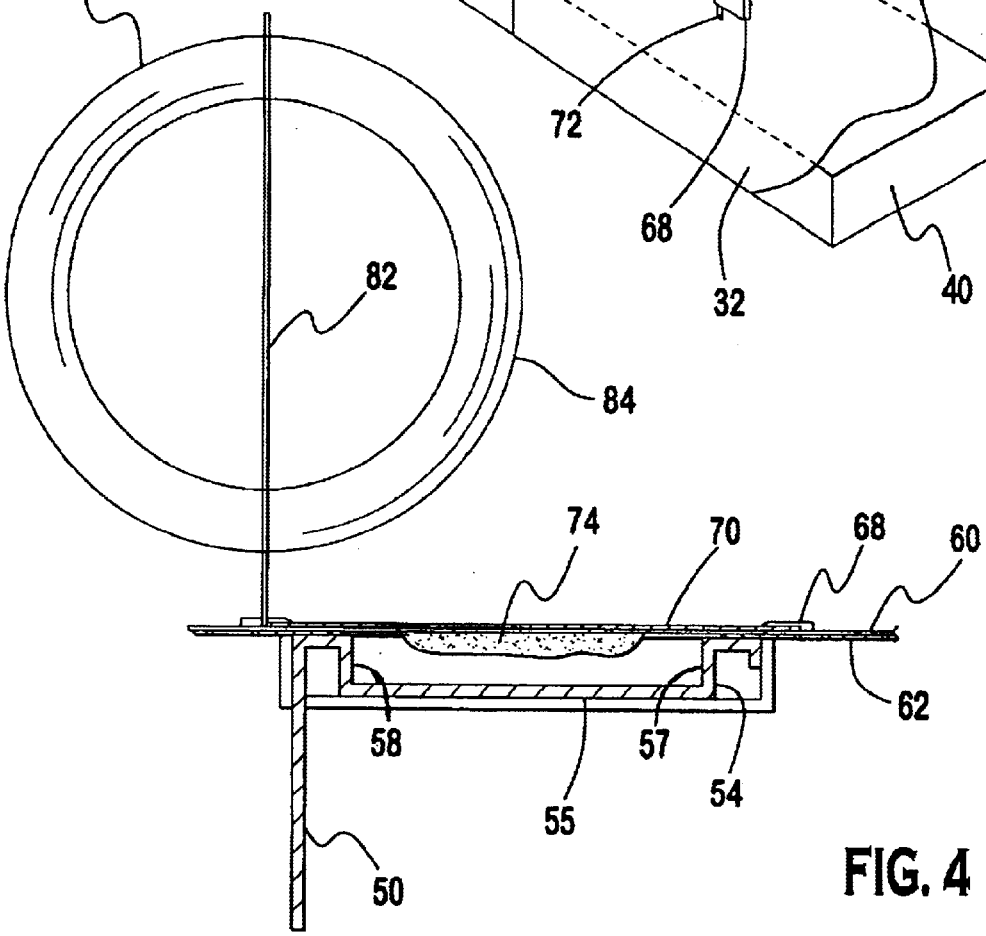
FIG. 4 is a cross sectional view of the damping mechanism.

Referring to FIGS. 3 and 4, the vibration damping features of the invention will now be described in greater detail. The tension mask 30 is terminated to a respective support blade member 40 along the lower edge 32 in a conventional manner such as by welding. The tension mask 30 has a plurality of strands 62 extending from a border 66. It should be understood that although only one edge 32 along the long side 24 is shown, on the opposite edge near the long side 22, similar border and attachment features are located. A plurality of cross wires 60 extend generally perpendicular to and over the strands 62. The cross wires 60 are electrically insulated from the strands 62 and extend over the strands 62 on a screen facing side. The cross wires 60 are terminated to a bus bar 64 extending along the short side 26. A sheath assembly 50 is provided inside of the bus bar 64. The sheath assembly 50 consists of a sheath 54 which is positioned on the gun facing side of the tension mask 30. A shield 70 is located over the sheath 54 on the opposite or screen facing side of the tension mask 30 such that both the strands 62 and the cross wires 60 lie between the sheath 54 and the shield 70. Also the sheath 54 lies beneath at least one strand 62. The sheath 54 has a pair of spaced apart mask engaging surfaces 52, 56. Extending from each mask engaging surface 52, 56 is a respective angled portion 57, 58. The angled portions 57, 58 are connected by a flat section 55. Near both the bottom and the top of the sheath 54, a pair of tabs 68 extend outward from the flat section 55 through apertures 72 in the mask border 66 and are bent to engage the screen facing side of the tension mask 30. The sheath assembly 50 is positioned such that the sheath 54 is positioned to have its mask engaging surface 56 in contact with at least one or several strands 62. Similarly, the shield 70 is positioned to overhang and be in precise alignment with at least one or several of the strands 62. This precision alignment ensures that the last mask aperture column will be useful for precisely printing the last phosphor triads on both sides of the screen. Additionally, the precision alignment ensures that the electron beam landing during to-tube operation on the last phosphor triads will have the proper clipping and leaving tolerances. Additionally, FIG. 4 shows a conductive adhesive 74 for attaching the cross wires 60 to the shield 70.

A vibration damping means can be applied along an edge of the sheath assembly 50. FIG. 4 shows one such vibration damping means, wherein vibration damper 80 is provided along an edge of the sheath assembly 50. The vibration damper 80 consists of an arm 82 extending from an edge of the shield 70. A ring 84 is loosely connected to the arm 82 for further absorbing vibrations along the mask 30 and sheath assembly 50. The ring 84 is allowed to freely slide in an aperture of the arm 82. When the tension mask 30 is excited by audio or any other energy, this energy which is transferred to the tension mask 30 is, in turn, transferred to the arm 82 thereby driving the ring 84 to slide in the aperture resulting in the energy being scrubbed away. Each sheath assembly 50 is assembled to the tension mask 30 and support blade member 40 as follows. First, the mask borders 66 are attached to the support blade member 40 under tension by conventional techniques such as welding. An insulative layer (not shown) is then applied over the screen facing side of the tension mask 30 to cover each of the strands 62. Cross wires 60 are then applied over the strands and terminated to the bus bar 64 such that they are insulated from the strands 62 and are positioned generally perpendicular to the strands 62. The sheath assemblies 50 are then applied by inserting the tabs 68 through the apertures 72 and bending the tabs 68 over the screen facing surface of the mask border 66. The tabs 68 are then preferably welded to the mask border 66. The shield 70 is then applied over the sheath 54 utilizing an adhesive such as a glass frit which is cured during tube processing. Both the sheath 54 and shield 70 are positioned such that the mask border 66 is in frictional contact with at least one mask strand 62 to damp vibrations in the tension mask 30.

Advantageously, the vibration damping features of the invention as described above serve to damp vibrations within the tension mask 30 which would otherwise cause undesirable gross electron beam misregister on the screen. As the embodiments that incorporate the teachings of the present invention have been shown and described in detail, those skilled in the art can devise other varied embodiments that incorporate these teachings without departing from the spirit of the invention.

What is claimed is:

1. A cathode-ray tube having a luminescent screen on a faceplate panel and a tension focus mask assembly, wherein the tension focus mask comprises:

a rectangular mask frame having a pair of long sides and a pair of short sides;

a tension mask extending between the long sides, the tension mask having a pair of mask borders in the vicinity of at least one attachment point to each of the long sides;

the tension mask including a plurality of strands extending between the mask borders and a plurality of cross wires extending approximately perpendicular to the strands and being electrically insulated from the strands;

a sheath assembly having a sheath, a shield and at least one damping element;

the sheath having at least one flat section which is attached to the mask border by tabs extending through openings in the mask border and being positioned under the mask border to be in frictional contact with at least one of the mask strands;

the shield being positioned and secured over the mask border and the cross wires opposite the sheath and having an inner edge which overhangs the sheath and at least one of the mask strands to be precisely aligned with one of the mask strands, whereby the precisely aligned shield provides a precise last mask aperture and facilitates precise printing of last phosphor triads of the luminescent screen; and the damping element attached to and protruding from the shield to reduce vibrations perpendicular to the mask.

2. The tension mask assembly of claim 1 wherein the sheath runs substantially parallel to said strands.

3. The tension mask assembly of claim 1 wherein the mask borders run substantially parallel to the cross wires and the mask borders extend beyond the sheath.

4. A cathode-ray tube having a luminescent screen on a faceplate panel and a tension mask assembly, wherein the tension mask assembly comprises:

a pair of tension mask support blade members for supporting a tension mask;

the tension mask having a pair of mask borders each being fixed to a respective tension mask support blade member and a plurality of strands extending between the mask borders;

a plurality of cross wires extending generally perpendicular to the strands on a screen facing side and at least one sheath assembly extending between and attached to the mask borders;

the sheath assembly having a sheath extending along one side of the mask in contact with at least one strand; and a shield attached to the cross wires of the mask in overlapping relation to the sheath.

5. The tension mask assembly of claim 4 wherein the sheath is fixed to the mask borders by a plurality of tabs passing through openings in the mask border.

6. The tension mask assembly of claim 4 further comprising a damping element being fixed to the shield and extending outward therefrom.

* * * * *